US007168388B2

(12) United States Patent
Nysether et al.

(10) Patent No.: US 7,168,388 B2
(45) Date of Patent: Jan. 30, 2007

(54) FOOT BRACE

(75) Inventors: Mark Nysether, Arlington, WA (US); Matthias Poischbeg, Everett, WA (US); R. Lee Rawls, Woodinville, WA (US)

(73) Assignee: Sea-Dog Corporation, Everett, WA (US)

( * ) Notice: Subject to any disclaimer, the term of this patent is extended or adjusted under 35 U.S.C. 154(b) by 0 days.

(21) Appl. No.: 11/079,915

(22) Filed: Mar. 8, 2005

(65) Prior Publication Data

US 2005/0241562 A1 Nov. 3, 2005

Related U.S. Application Data

(60) Provisional application No. 60/551,114, filed on Mar. 8, 2004.

(51) Int. Cl.
*B63H 25/00* (2006.01)
*B63B 35/71* (2006.01)

(52) U.S. Cl. ..... 114/363; 114/153; 114/347

(58) Field of Classification Search ..... 114/153, 114/347, 363
See application file for complete search history.

(56) References Cited

U.S. PATENT DOCUMENTS 4,942,840 A 7/1990 Masters et al.
6,523,492 B1 * 2/2003 Neckar et al. ..... 114/347
6,612,252 B2 * 9/2003 King et al. ..... 114/153

* cited by examiner

*Primary Examiner*—Sherman Basinger
(74) *Attorney, Agent, or Firm*—Christensen O'Connor Johnson Kindness PLLC

(57) ABSTRACT

A kayak user braces his or her feet against footrests that project inward from the sides of the kayak. The positions of the footrests can be adjusted to accommodate users of different heights, and the footrests can be pivoted to control the position of the rudder of the kayak.

5 Claims, 11 Drawing Sheets

FOOT BRACE

CROSS-REFERENCE TO RELATED APPLICATION

This application claims the benefit of U.S. Provisional Application No. 60/551,114, filed on Mar. 8, 2004.

FIELD OF THE INVENTION

The present invention pertains to a foot brace having a footrest adjustable toward and away from a user and conveniently lockable in a selected adjusted position.

BACKGROUND OF THE INVENTION

In a typical personal watercraft, such as a kayak, a user braces his or her feet against footrests that project inward from the sides of the craft. Often the positions of the footrests can be adjusted to accommodate users of different heights. See, for example, U.S. Pat. No. 4,942,840, which shows an adjustable foot brace. In some applications, the footrests are connected to a rudder assembly to be used in steering the craft.

SUMMARY OF THE INVENTION

A control rod extends lengthwise of an elongated slide channel mounted in a personal watercraft such as a kayak. A base unit having an inward projecting footrest is slidable along the slide channel. The control rod has longitudinally spaced teeth which will interfit with slots of the base unit to lock the base unit and footrest in a selected longitudinal position. The control rod has an extended handle portion within easy reach of a user for locking and unlocking the base unit and footrest. The footrest can be a pedal that swings to control the position of a rudder.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
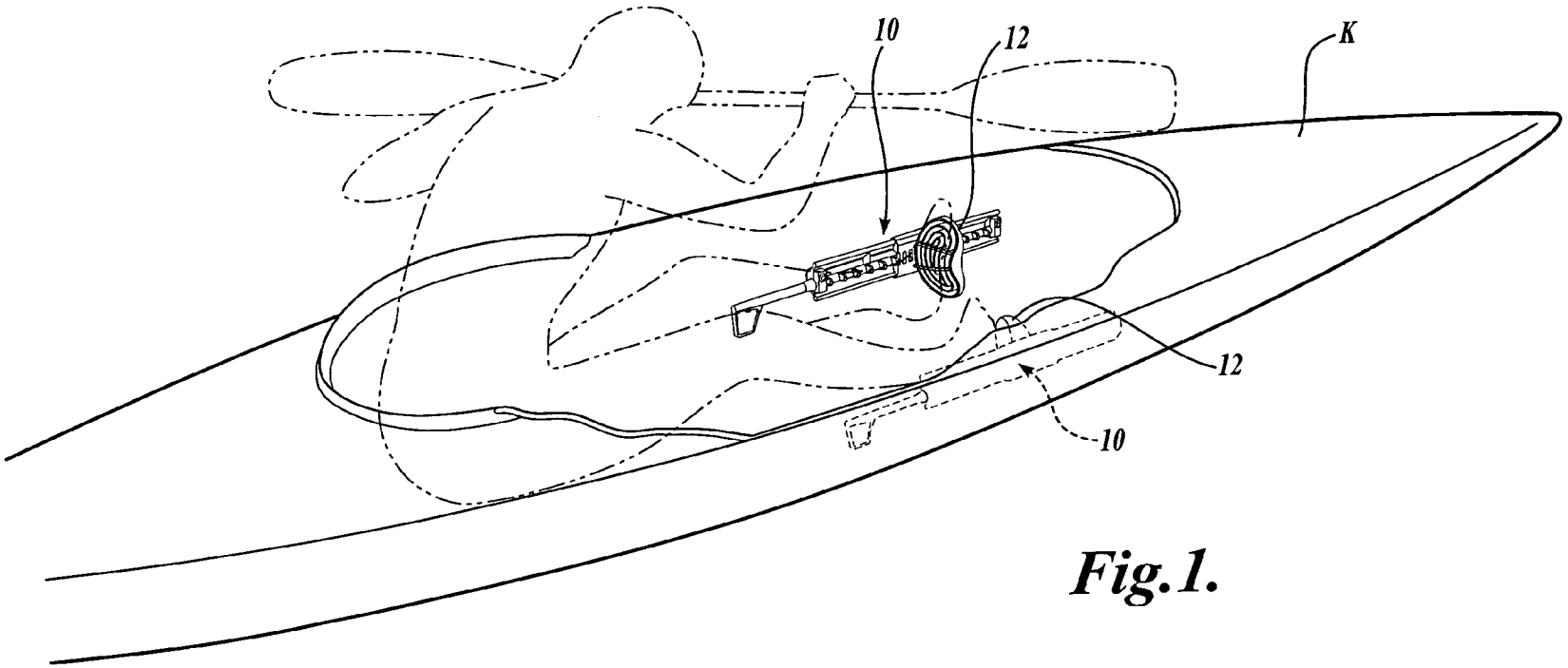
FIG. 1 is a diagrammatic perspective of a foot brace in accordance with the present invention as mounted in a watercraft, namely, a kayak.

FIG. 1 is a diagrammatic perspective of a foot brace 10 in accordance with the present invention as mounted in a watercraft, namely, a kayak K. Brace 10 has a footrest 12 that is adjustable fore and aft. The footrest can be locked in a desired adjusted position. Two such foot braces are provided, one at the left (port) and one at the right (starboard), the right foot brace being illustrated in broken lines at the bottom of FIG. 1. The right foot brace is shown in detail in FIGS. 2–8. The left foot brace is the mirror image of the right.

Referring to FIGS. 2–8, the footrest 12 projects from an integral base 14 having hooked sides 16 for guiding the base and footrest along top and bottom rails 18 of an elongated slide channel 20. A long elongated control rod 22 extends lengthwise through the channel 20 and has regularly spaced latch teeth 24. In the locked position illustrated in FIG. 2, the latch teeth interengage with slots 26 in the base 14 of the footrest, to lock the footrest in a selected position.

The control rod 22 is rotatable by manipulation of an external control handle 28 which is oriented so as to be spaced from the slide channel 20 in the direction of the user. Thus, the user can conveniently reach down to manipulate the control handle. The control rod 22 has a forward end journaled between the forward end of the channel 20 and a transverse cap 30. Similarly, the rearward end portion of the control rod 22 is journaled in the rear or aft end 32 of the channel and a cap 34. An enlargement 36 on the control rod prevents longitudinal forward sliding of the rod by engagement against the cap 34 and channel end 32, and the adjacent latch tooth 24 prevents aftward sliding.

Figure 4:
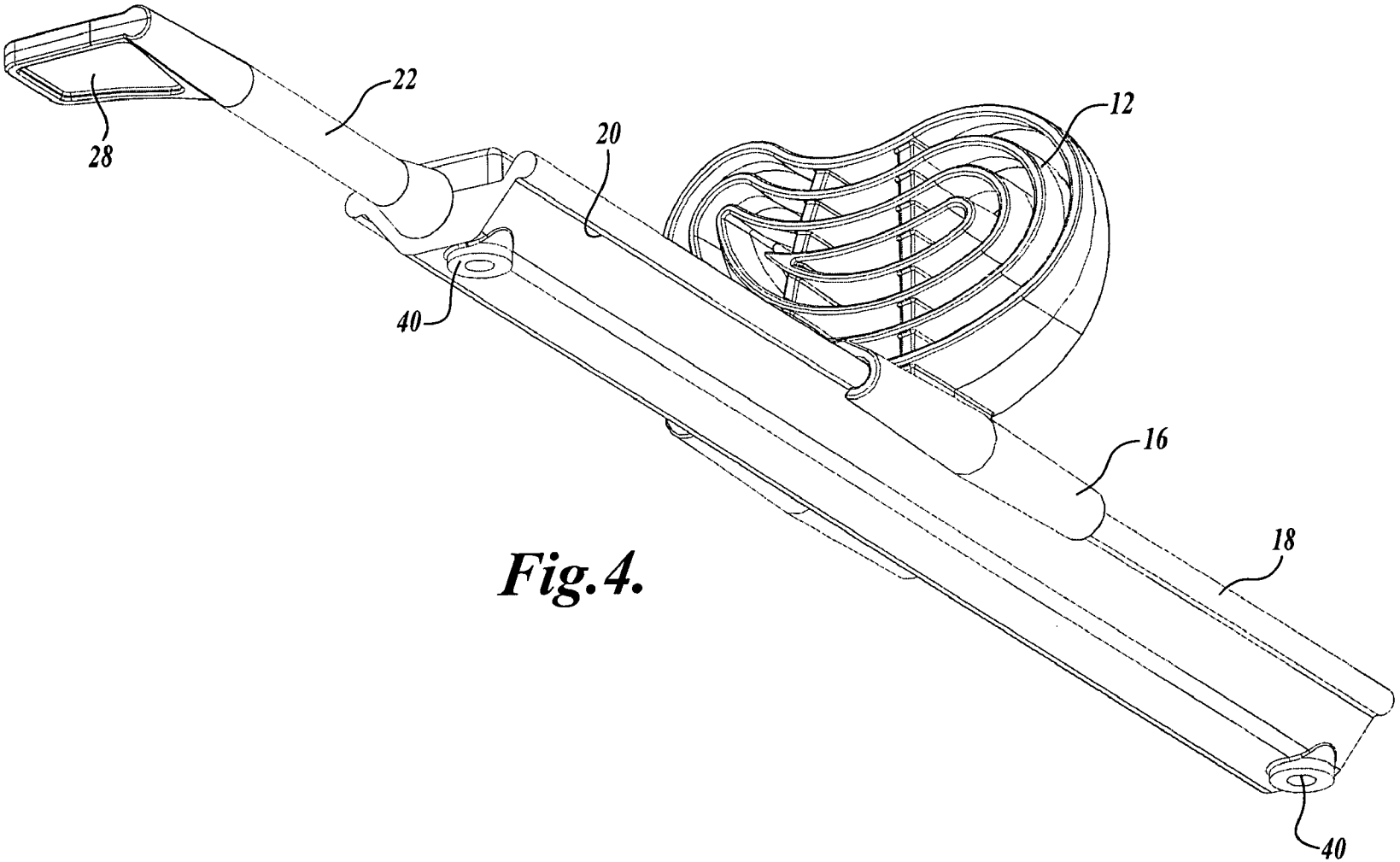
FIG. 4 is an exterior side, rear perspective of the foot brace removed from the kayak.
Figure 5:
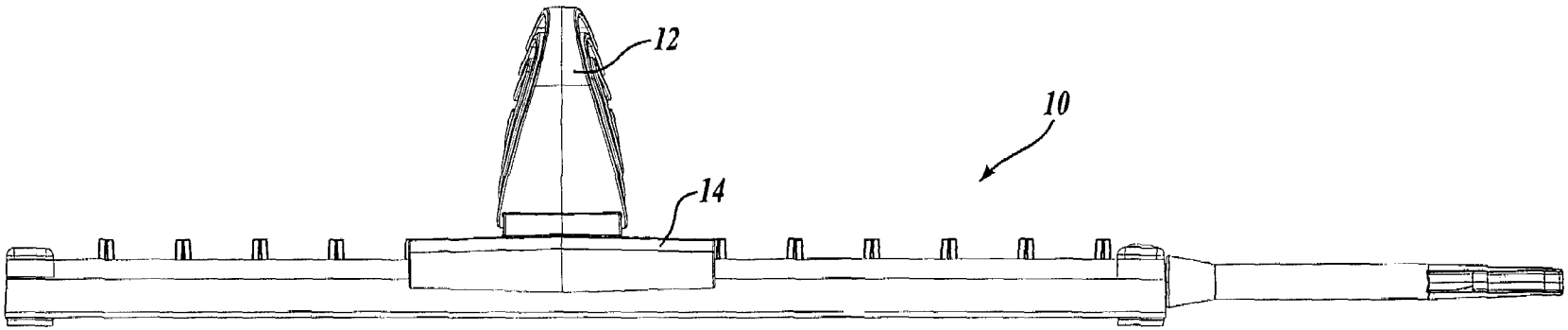
FIG. 5 is a bottom plan of the foot brace.
Figure 6:
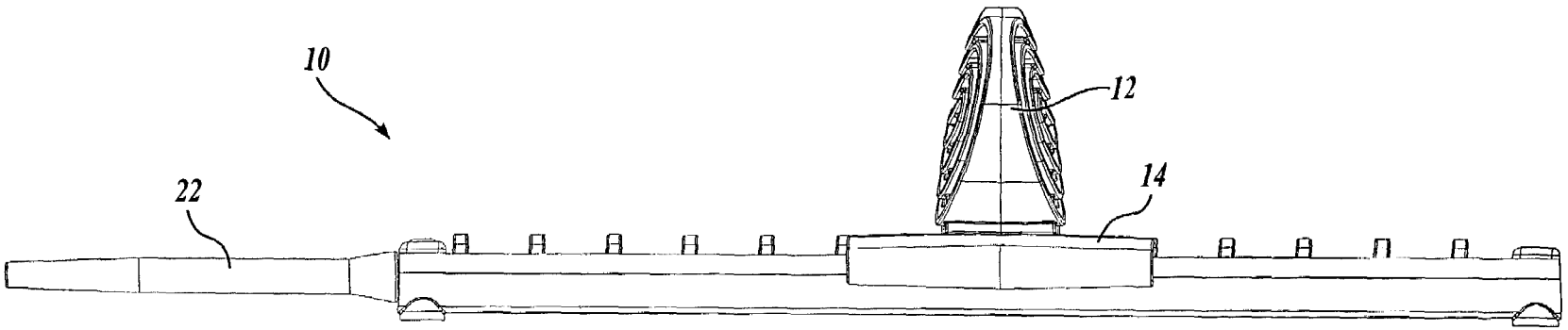
FIG. 6 is a top plan of the foot brace.
Figure 7:
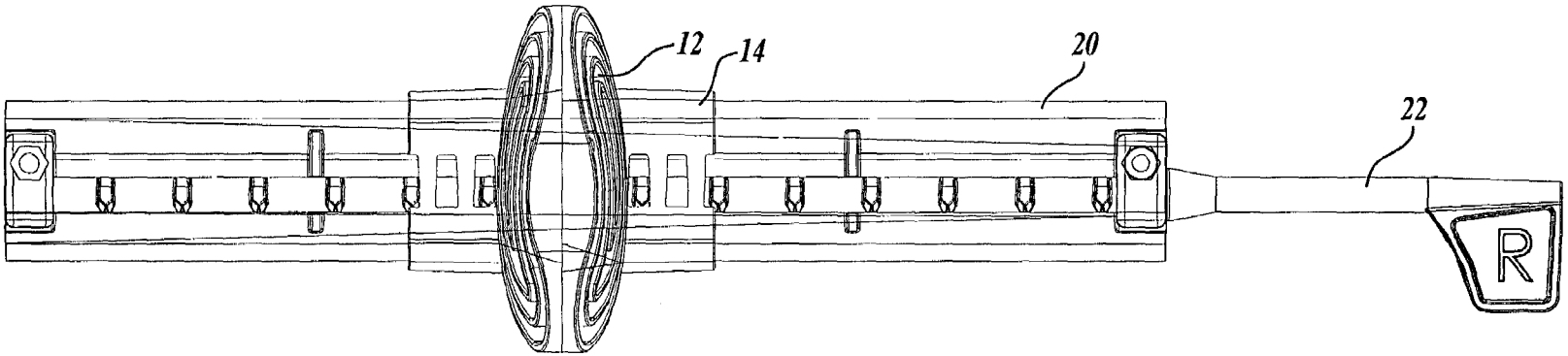
FIG. 7 is an interior side elevation of the foot brace.
Figure 8:
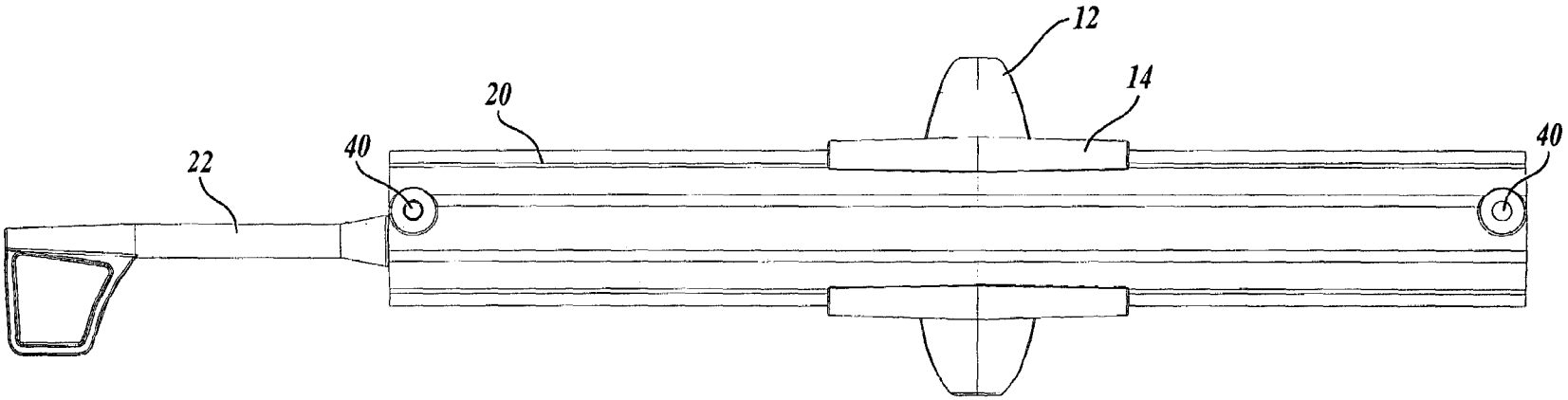
FIG. 8 is an exterior side elevation of the foot brace.

Caps 30 and 34 are clamped to their corresponding channel ends by fasteners 38 which can extend through the channel and into mounting structure of the watercraft. For example, FIG. 4 shows the channel openings 40 which are aligned with the respective openings of the cap pieces 30 and 34 such that fasteners 38 of appropriate size project through the channel and secure the assembly in the watercraft.

Figure 2:
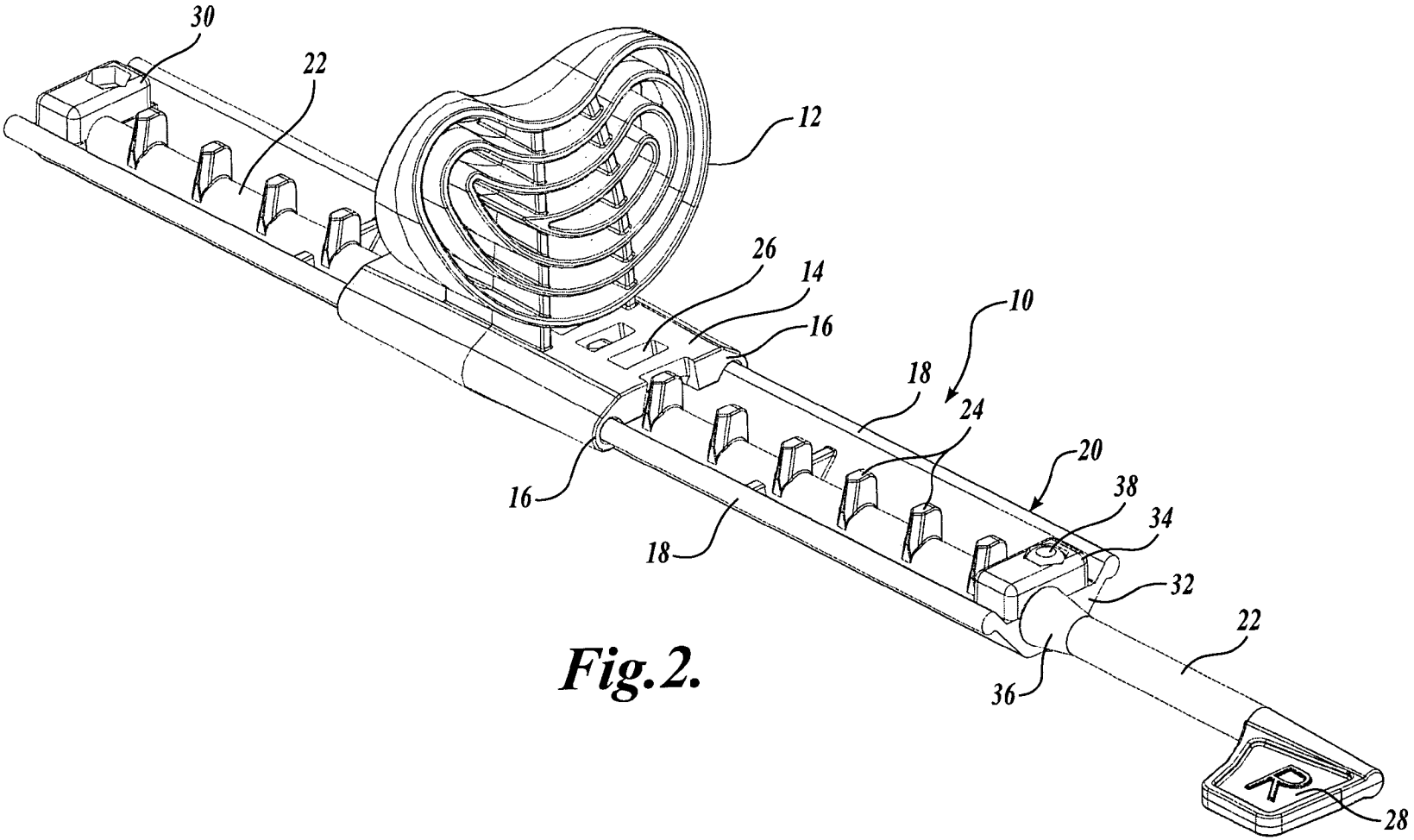
FIG. 2 is an interior side, rear perspective of the foot brace removed from the kayak.
Figure 3:
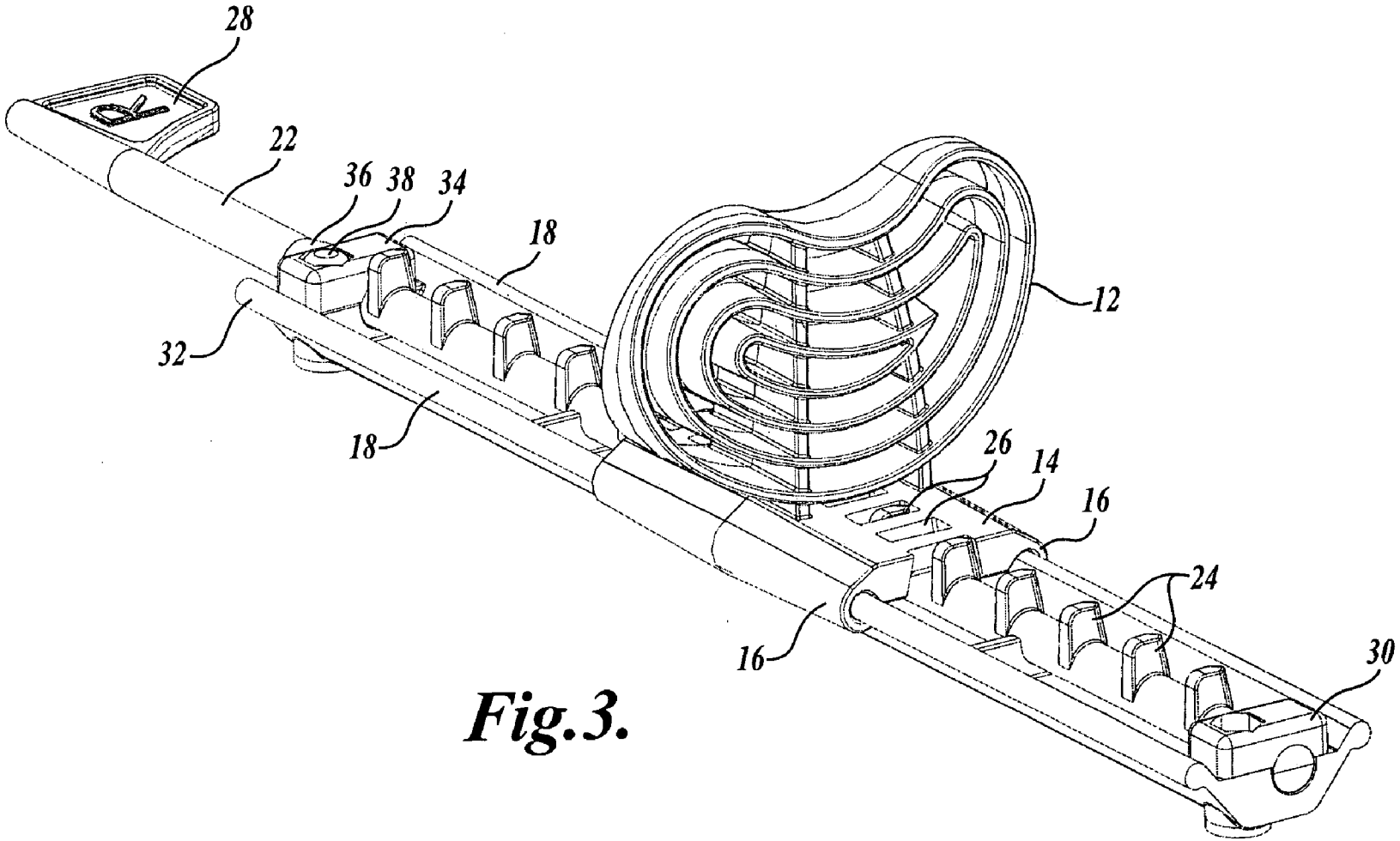
FIG. 3 is an interior side, front perspective of the foot brace removed from the kayak.
Figure 9:
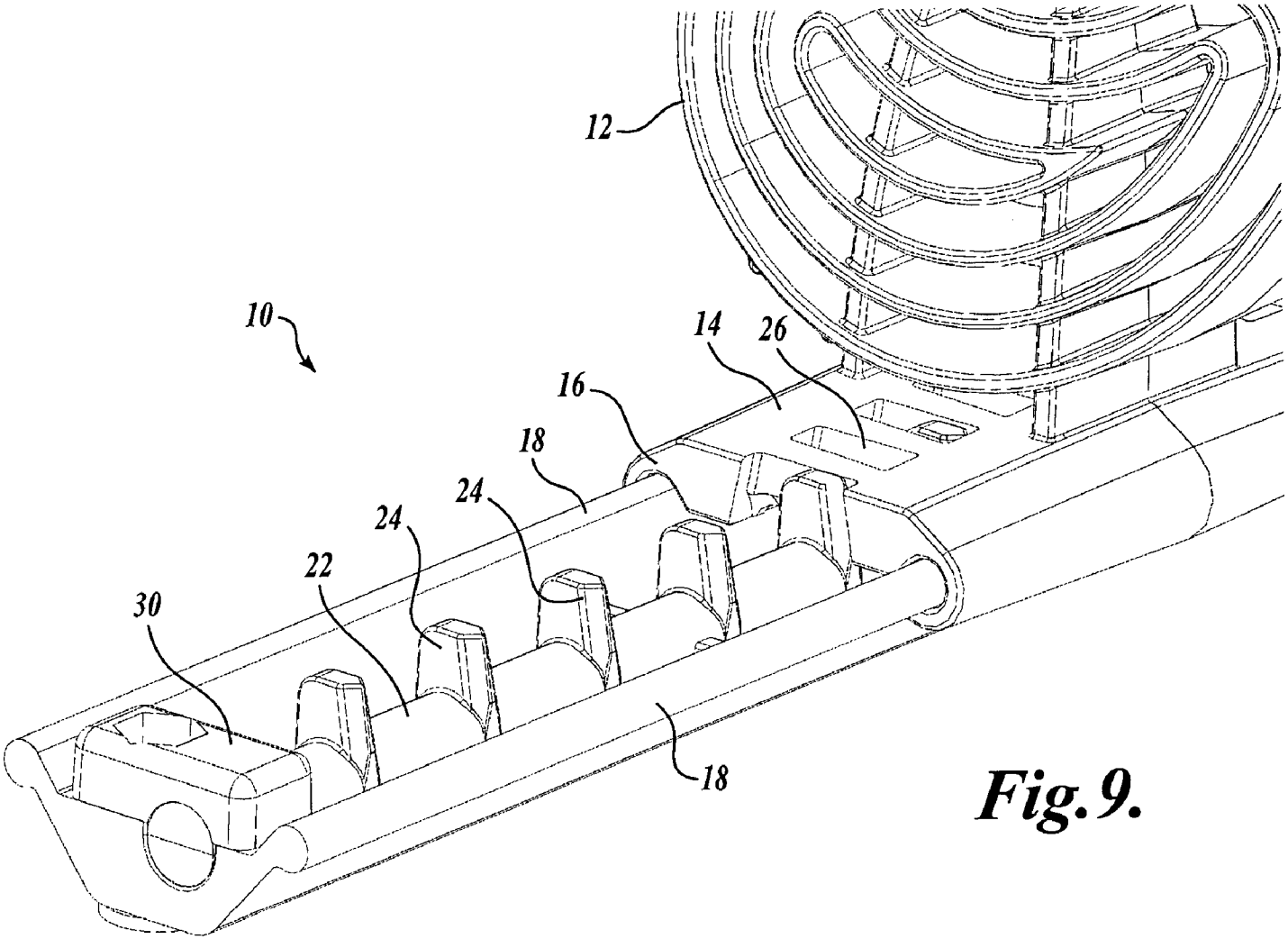
FIG. 9 is an enlarged, fragmentary perspective of the leading end portion of the foot brace.

To unlock the footrest 12 and allow longitudinal sliding movement thereof, the user need only rotate the control handle 28 90°, counterclockwise as viewed in FIG. 2, about an axis extending lengthwise of the control rod and slide channel, to disengage the latch teeth 24 from the slots 26. The user then can slide the footrest to the desired position and rotate the control handle 90° in the other direction to reengage selected latch teeth with the slots 26, and lock the footrest 12 in the new position. Preferably, the bottom edge portions of the latch piece are beveled, as best seen in FIG. 9, to assist in guiding the latch teeth into the nearest slot. The incremental adjustment permitted by the mechanism is determined by the space between adjacent slots 26. In the illustrated embodiment, the latch teeth are spaced apart a distance exactly twice the distance between adjacent slots, so that a latch tooth engages in every other slot.

All parts can be formed of rigid plastic, except the fasteners which can be screws or bolts.

Figure 10:
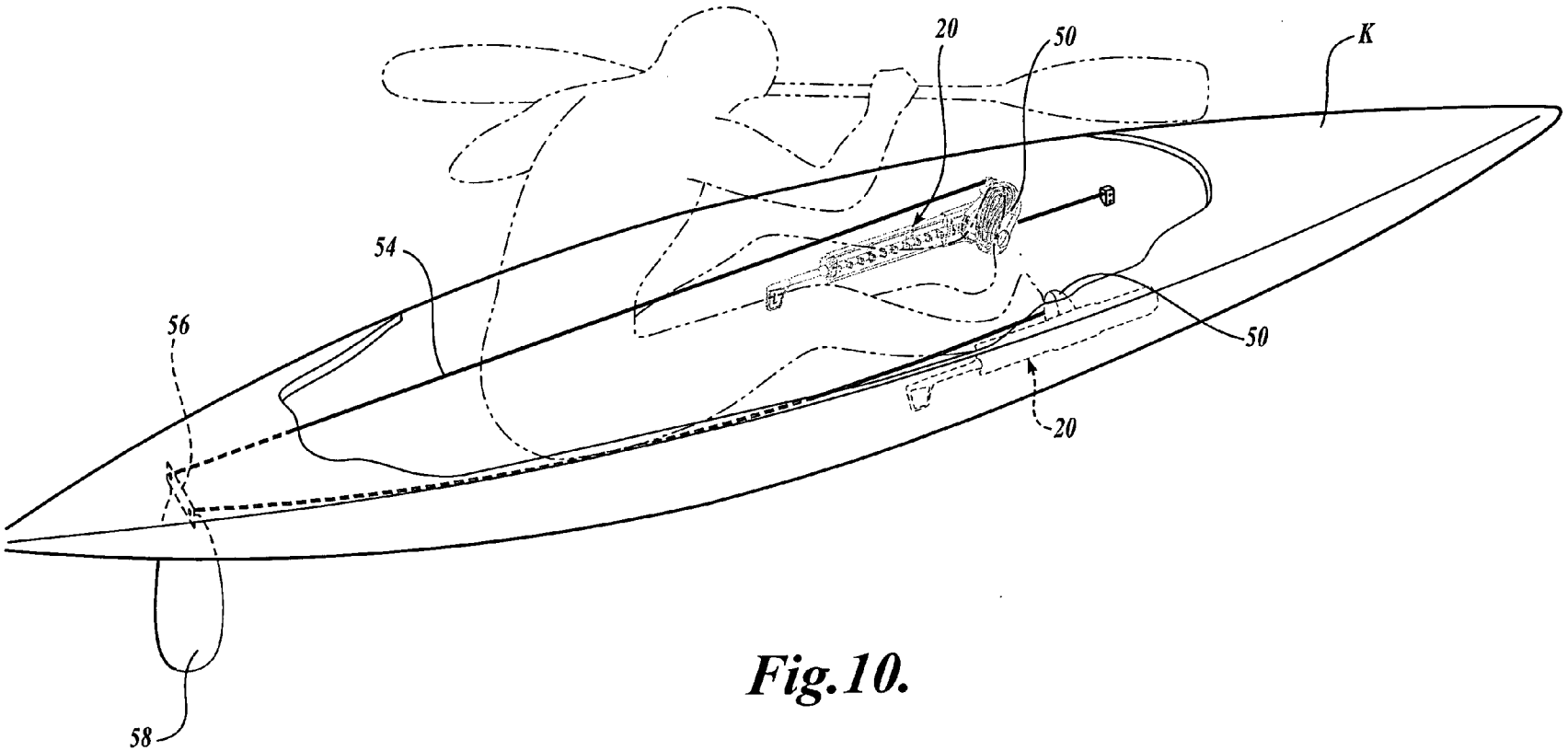
FIG. 10 is a diagrammatic perspective of a second embodiment of a foot brace in accordance with the present invention as mounted in a kayak.
Figure 11:
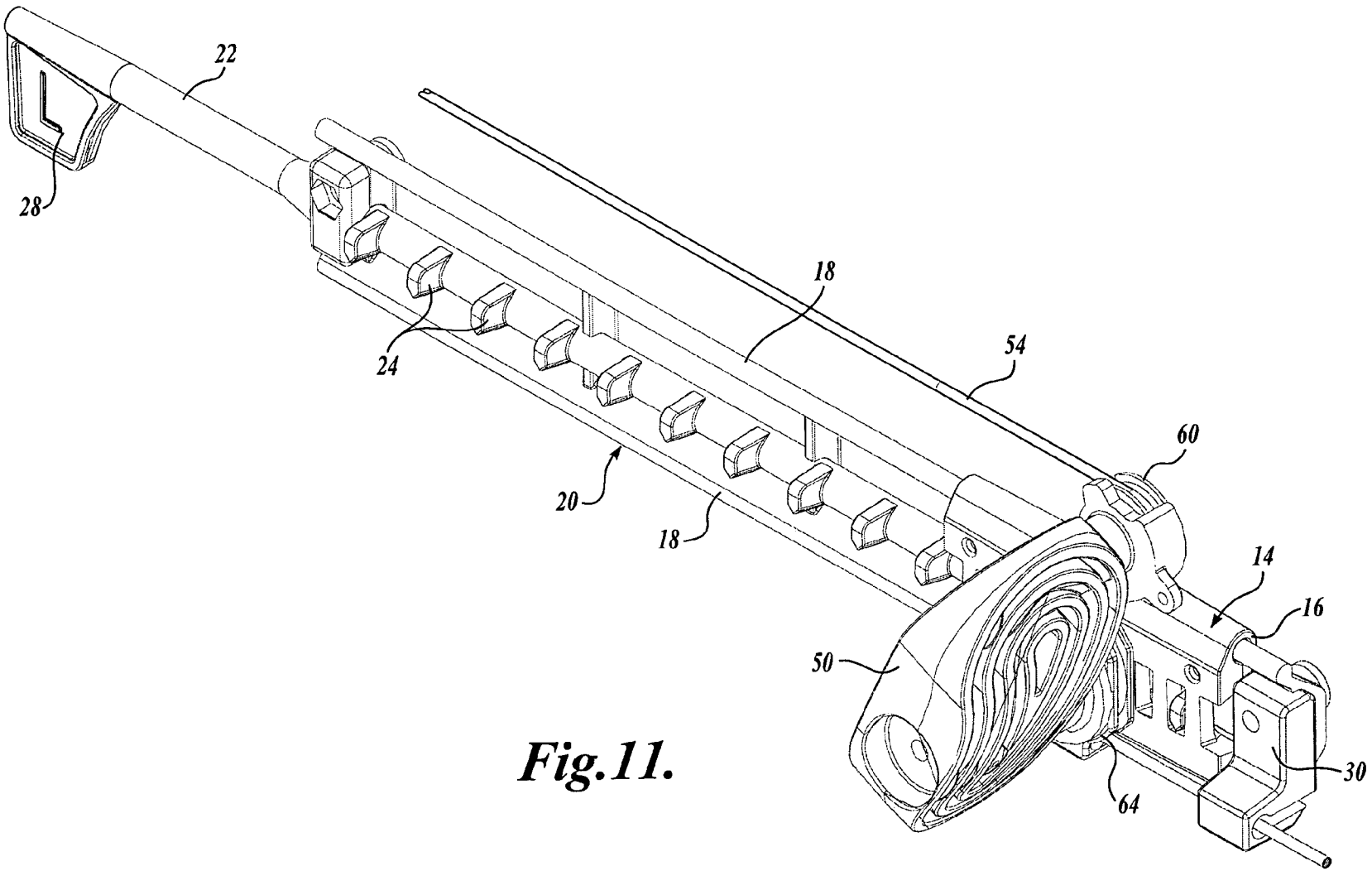
FIG. 11 is an interior side, front perspective of the foot brace of FIG. 10 removed from the kayak.

FIGS. 10–13 illustrate a second embodiment of a foot brace in accordance with the present invention, having modifications that permit rudder control. Many of the parts are the same or essentially the same as the embodiment described above, and are similarly numbered. With reference to FIG. 11, these include the control rod 22 with its control handle 28 and latch teeth 24. The control rod extends through the slide channel 20, and the latch teeth 24 selectively interengage with the base 14 which has hooked sides 16 for guiding the base along top and bottom rails 18 of the slide channel.

Figure 12:
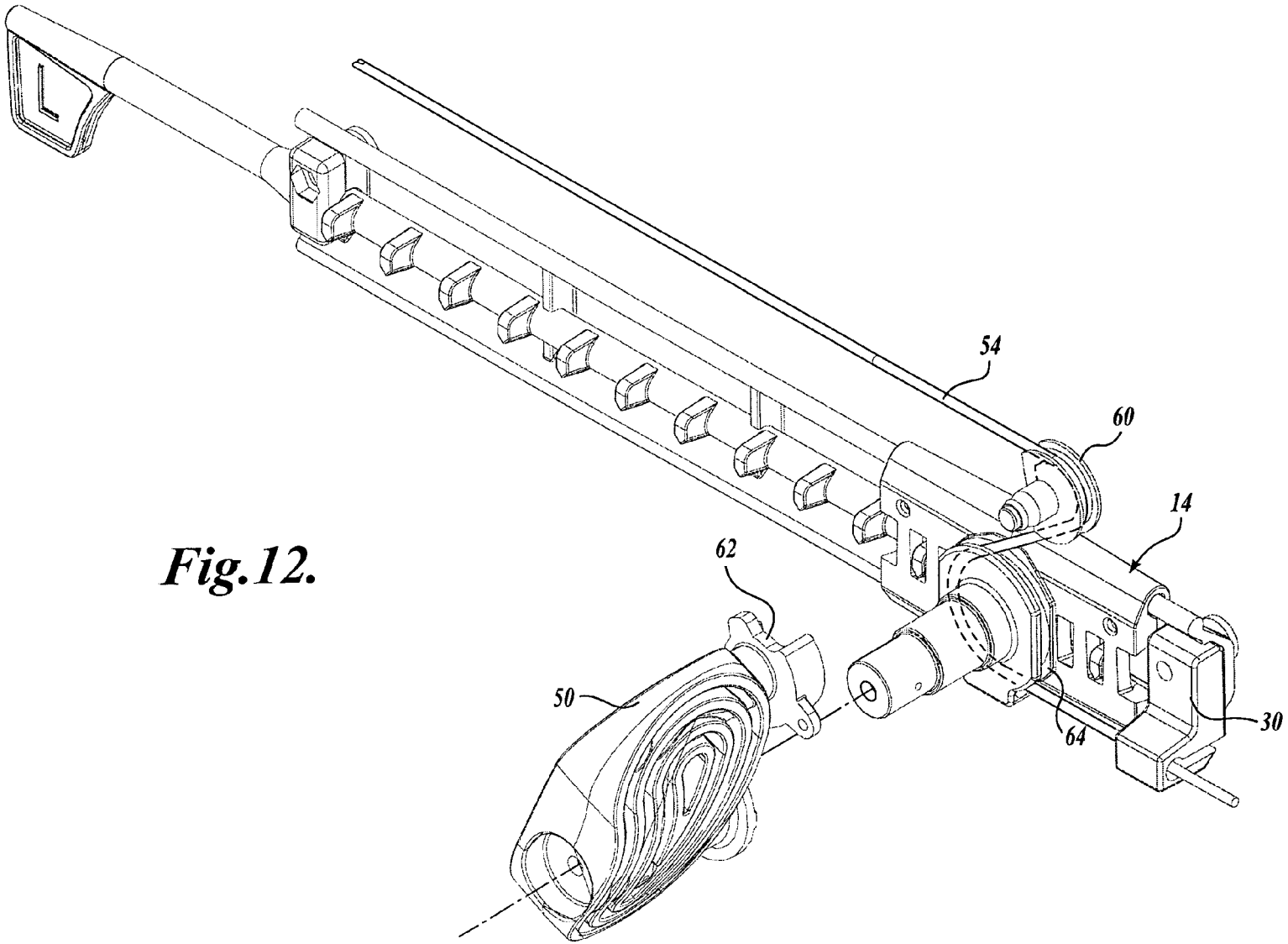
FIG. 12 is a perspective corresponding to FIG. 11 with some parts shown in exploded relationship.

A footrest is in the form of a pedal 50 that swings about a horizontal axis relative to the base 14, rather than being stationarily mounted on the base as in the previously described embodiment. For example, FIG. 12 shows the base 14 and inward projecting mounting stud 52 received in a bore toward the bottom of the pedal 50. Thus, the top portion of the pedal can be swung fore and aft by the user.

FIG. 12 also illustrates the routing of a control cable 54 for a rudder. With reference to FIG. 10, control cable 54 connects at its rear end to a control arm 56 for the rudder 58. A similar control cable connects at the other side. Manipulation of the control cables adjusts the position of the rudder. More specifically, as one cable is shifted forward, the other is shifted rearward, and the rudder will turn.

Returning to FIG. 12, the leading end portion of the control cable 54 extends around a pully 60 rotatably carried at the upper portion 62 of the pedal 50. From pully 60 the control cable 54 extends rearward and around another pully 64 rotatably mounted on the sliding base 14. The axis of pully 64 is the same as the swinging axis for the pedal. From the second pully 64, the control cable extends to and is anchored in the leading end cap 30.

Figure 13:
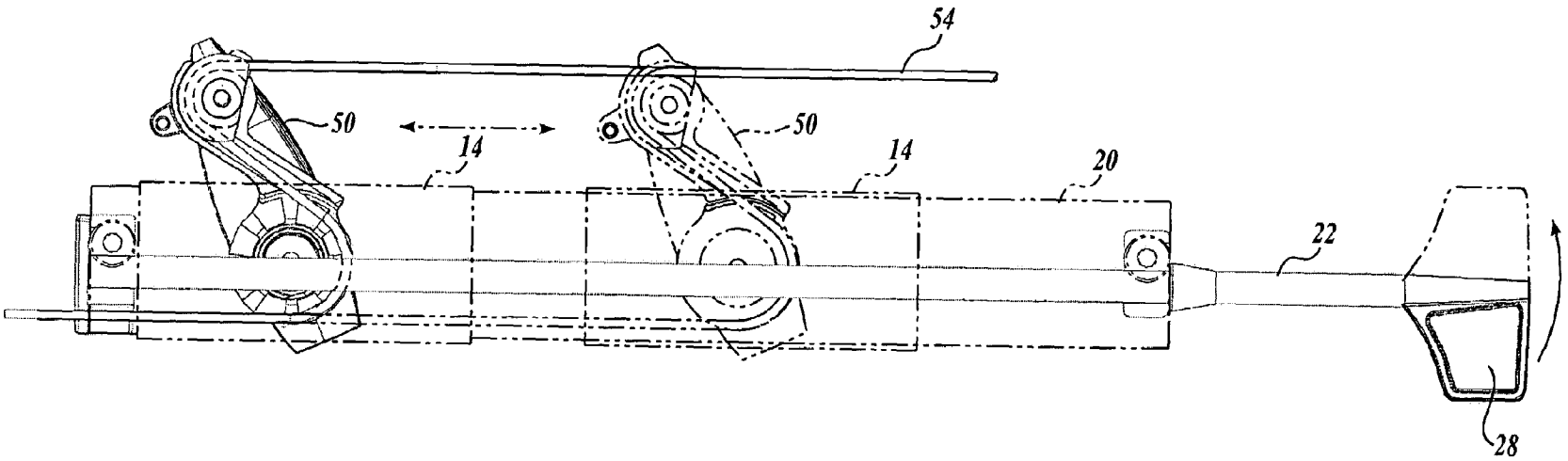
FIG. 13 is a diagrammatic interior side elevation of the second embodiment of foot brace with parts shown in different adjusted positions.

With reference to FIG. 13, the longitudinal position of the base 14 and, consequently, the pedal 50 can be adjusted fore and aft of the channel 20 as for the previously described embodiment, by manipulation of the control handle 28 and control rod 22 and intertitting the slots of the base with selected latch key of the control rod. This aspect is identical to the aspect previously described. Also, the position of the rudder control cable 54 is not affected so long as the pedal is not rotated. Tension of the cable remains the same as the length of the upper stretch increases and the length of the lower stretch decreases. From any position in which the base 14 is locked, the position of the rudder can be controlled by adjusting the angle of the pedals 50. With reference to FIG. 13, if the pedal is tilted to the left, i.e., forward, tension is applied to the control cable which tends to swing the rudder as well as swing the other pedal oppositely. Thus, the embodiment of FIGS. 10–13 allows both longitudinal adjustment of the pedals and control of the rudder position.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A foot brace for a watercraft comprising:

an elongated slide channel mountable in a watercraft;

a base unit slidable along the channel;

a footrest carried by the base unit; and an elongated control rod extending lengthwise of the channel and rotatably mounted therein for rotation about an axis extending lengthwise of the control rod and the channel, the control rod and channel having cooperating members that interfit and lock the base unit to the slide channel when the control rod is in a first rotated position, the cooperating members being freed from each other to permit movement of the base unit lengthwise of the slide channel when the control rod is rotated from the first rotated position to a second rotated position, the control rod having a handle portion extending beyond the slide channel and oriented so as to be spaced from the slide channel in the direction of the user for manipulation by a user.

2. The foot brace defined in claim 1, in which the control rod and the base unit have cooperating latch teeth and slots that inter-engage when the control rod is in the first position, such cooperating teeth and slots being disengaged when the control rod is in the second position.

3. The foot brace defined in claim 1, in which the control rod has regularly spaced projecting latch teeth, and the base unit has one or more slots inter-engagable with the latch teeth, the latch teeth and the one or more slots being inter-engaged when the control rod is in the first position and being disengaged when the control rod is in the second position.

4. The foot brace defined in claim 3, in which the latch teeth have beveled edges for guiding the teeth into the one or more slots of the base unit as the control rod is rotated from the second position to the first position.

5. The foot brace defined in claim 3, in which the base unit has a plurality of slots spaced apart regularly in a direction lengthwise of the slide channel, the latch teeth being spaced apart a distance twice the distance between adjacent slots.

* * * * *